US009789589B2

(12) United States Patent
Migliori

(10) Patent No.: US 9,789,589 B2
(45) Date of Patent: Oct. 17, 2017

(54) CLAMPING DEVICE HAVING A FIRST LOCKING MECHANISM WITH A FIRST PROJECTION AND A SECOND PROJECTION IN COMMUNICATION WITH A SECOND LOCKING MECHANISM

(71) Applicant: UNIVER S.p.A., Milan (IT)

(72) Inventor: Luciano Migliori, Milan (IT)

(73) Assignee: UNIVER S.P.A., Milan (IT)

( * ) Notice: Subject to any disclaimer, the term of this patent is extended or adjusted under 35 U.S.C. 154(b) by 133 days.

(21) Appl. No.: 15/004,041

(22) Filed: Jan. 22, 2016

(65) Prior Publication Data

US 2016/0214236 A1 Jul. 28, 2016

(30) Foreign Application Priority Data

Jan. 28, 2015 (EP) ..... 15152789

(51) Int. Cl.
*B25B 5/12* (2006.01)
*B25B 5/16* (2006.01)

(52) U.S. Cl.
CPC ..... *B25B 5/16* (2013.01); *B25B 5/122* (2013.01)

(58) Field of Classification Search
CPC ..... B23Q 11/0875; B25B 5/04; B25B 5/064; B25B 5/108; B25B 5/122; B25B 5/16
USPC ..... 269/32, 90, 94, 228, 233
See application file for complete search history.

(56) References Cited

U.S. PATENT DOCUMENTS 3,027,155 A * 3/1962 Paterson ..... B25B 5/122 269/228
4,576,367 A * 3/1986 Horn ..... B25B 5/122 269/228
6,648,317 B2 * 11/2003 Takahashi ..... B25B 5/087 269/228

(Continued)

FOREIGN PATENT DOCUMENTS

DE 298 17 335 U1 2/1999
EP 2 548 700 A1 4/1999

(Continued)

*Primary Examiner* — Joseph J Hail
*Assistant Examiner* — Arman Milanian
(74) *Attorney, Agent, or Firm* — Christopher C. Dremann, P.C.; Christopher C. Dremann

(57) ABSTRACT

A clamping device has a clamping arm mounted pivotable in a housing of the clamping device, a first locking means pivotable corresponding to the pivoting movement of the clamping arm, and a second locking means arranged in the pivot path of the first locking means and mounted in the housing, wherein the two locking means interact in an end position of the clamping arm. The first locking means, in the region of the end remote from the pivot axis of the first locking means, on the side facing the second locking means, has a recess defined at the side by two projections, wherein the second locking means contacts the projections when the clamping arm pivots into the end position thereof and is inserted into the recess in the end position, wherein the first locking means has a first portion which receives the first projection, and a second portion which receives the second projection, wherein the two portions, with the second locking means acting upon the two projections, are movable toward one another against a spring force with the spacing between the projections increasing.

15 Claims, 11 Drawing Sheets

(56) References Cited

U.S. PATENT DOCUMENTS

| | | | | |
|---|---|---|---|---|
| 8,561,973 | B2 * | 10/2013 | Martin | E05C 19/14 269/201 |
| 2002/0017751 | A1 | 2/2002 | Takahashi | |
| 2005/0194729 | A1 * | 9/2005 | Moilanen | B25B 5/061 269/32 |
| 2006/0208408 | A1 * | 9/2006 | Migliori | B25B 5/087 269/32 |
| 2012/0074633 | A1 * | 3/2012 | Fleischer | B25B 5/122 269/47 |

FOREIGN PATENT DOCUMENTS

| | | | | |
|---|---|---|---|---|
| EP | 2 821 181 | A1 | 1/2015 | |
| IT | EP 2821181 | A1 * | 1/2015 | B25B 5/122 |
| JP | FR 2812576 | A1 * | 2/2002 | B25B 5/122 |

* cited by examiner

CLAMPING DEVICE HAVING A FIRST LOCKING MECHANISM WITH A FIRST PROJECTION AND A SECOND PROJECTION IN COMMUNICATION WITH A SECOND LOCKING MECHANISM

CROSS-REFERENCE TO RELATED APPLICATION

This United States non-provisional patent application claims the benefit of priority to European Application No. EP 15 152 789.2 filed on Jan. 28, 2015, the entire disclosure of which is incorporated herein by reference.

FIELD OF THE INVENTION

The invention relates to a clamping device, in particular to a toggle lever clamping device, to be used especially in body construction in the automotive industry.

BACKGROUND OF THE INVENTION AND RELATED ART

Different designs of clamping devices which are to be actuated by hand or by fluid pressure, especially by air pressure, are known. These types of clamping devices, for example toggle lever clamping devices, are arranged not only in a horizontal manner, but also under arbitrary spatial conditions. In particular, in the case of overhead design, in the event of a drop in pressure, or when heavy loads are connected to the clamping arm, the clamping arm can move unintentionally into an unwanted position. This can result in damage, in the worst case even in injury.

A toggle lever clamping device is known for example from EP 2 548 700 A1.

Another clamping device which includes features of the present invention is known from DE 298 17 335 U1. It has a housing and a pivotably drivable shaft which is mounted in the housing. As a result of supplying fluid pressure, for example as a result of supplying compressed air to a cylinder of the clamping device or, however, by supplying correspondingly manually applied force by means of a hand lever, said shaft can be moved back and forth between an open position and a closed position of a clamping arm of the clamping device. The shaft is mounted in the housing and is removed out of the housing on the remote sides of said housing. The ends of the shaft are realized as positive locking parts which comprise a square-shaped cross section. The clamping arm which is arranged outside the housing comprises two legs which receive clamping jaws in the region of the ends thereof. As a result, a clamping connection, which is positive-locking with reference to rotation, between the arrangement of clamping arm and clamping jaws and the shaft is generated in the region of the shaft ends between the legs and the clamping jaws. The clamping device comprises a first locking means which is mounted in one of the clamping jaws and is pivotable together with the shaft, in addition a second locking means which is arranged in the pivot path of the first locking means and is mounted in the housing. The two locking means interact releasably in a defined pivot position of the clamping arm. The first locking means comprises a locking segment which is connected fixedly to the clamping jaw and a latching bolt which is connected to said locking segment. With reference to the locking segment, the latching bolt can be arranged in several angular positions with reference to the pivot axis of the clamping arm, for example at an opening angle of 45°, beginning every 15°, up to 135°. The locking segment is provided with blind bores corresponding to said selectable positions of the latching bolt. The second locking means comprises a U-shaped spring which is mounted in the housing, and more particularly, is mounted in a separate component that is connected to the housing. When the clamping arm is transferred into the defined pivot position, the latching bolt contacts the U-shaped spring in the region of the free ends of the two spring legs and expands the spring slightly in order to be moved completely into the recess defined by the spring in the defined position of the clamping arm, the two ends of the spring legs being pulled back such that a pivoting back of the clamping arm out of said defined pivot position is only possible as a result of applying increased torque which acts on the shaft of the clamping device. However, this is dimensioned such that the clamping arm is not able to move unintentionally out of said defined pivot position which corresponds to the previously set opening position of the clamping arm.

OBJECTS OF THE INVENTION

It is an object of the present invention to ensure that the two locking means interact in a low-wearing manner with the clamping arm securely locked with the two locking means in the locking position.

In the case of a clamping device according to the invention, it is provided that the first locking means, in the region of the end thereof which is remote from the pivot axis thereof, on the side facing the second locking means, comprises a recess which is defined at the side by two projections, wherein the second locking means contacts the projections when the clamping arm pivots into the end position thereof and is inserted into the recess in the end position, wherein the first locking means comprises a first portion which receives the one first projection, and a second portion which receives the other second projection, wherein the two portions, with the second locking means acting upon the two projections, are movable toward one another against a spring force with the spacing between the projections increasing.

It is desirable in the case of a clamping device according to the invention, consequently, that the first locking means comprises two portions which are movable toward one another against the spring force with the spacing between the projections of the first locking means increasing. If, accordingly, the first locking means is pivoted toward the stationary second locking means fixed to the housing, the two projections of the first locking means contact the second locking means, which acts in such a manner on the two projections that the two portions of the first locking means are moved slightly away from one another in opposition to the spring force. As a result of said relative mobility of the two portions of the first locking means toward one another, the projections can be moved past the second locking means with reduced force applied to said second locking means. The two portions of the first locking means. and consequently, the two projections of the first locking means are moved toward one another again when the clamping arm or the first locking means is transferred into the end position thereof such that the projections of the first locking means are arranged behind the apex points of the second locking means which face the projections.

Said development of the clamping device ensures secure locking of the clamping arm with the two locking means in the locking position and, over and above this, low-wearing interaction between the two locking means due to the projections or portions of the first locking means which are movable toward one another in opposition to the spring force. Said advantageous method of operation is also provided when the clamping device is transferred out of the locking position; in this connection, the first locking means is moved back out of the locking position with the second locking means.

The movement of the two portions of the first locking means in order to increase the spacing between the projections with respect to one another can be different. In a preferred manner, this is a rotational movement of the two portions with respect to one another or a linear movement of the two portions with respect to one another.

The two projections of the first locking means can form a structural unit with the respective first or second portion, the respective projection in the case of the first portion or second portion being realized as a bulging of said portion. However, it is deemed to be particularly advantageous when the two projections are realized as rollers, in particular as rotatably mounted rollers. Where rotatable rollers are used, said rollers of the first locking means contact the second locking means when producing the locking and roll along it. This contributes in a lasting manner to a further improvement in the interaction between the two locking means under the aspect of wear reduction. The rollers can be developed differently. However, a realization of the respective roller as a cylindrical roller is preferred.

Under the aspect of the mobility of the two portions of the first locking means with respect to one another, it is deemed to be particularly advantageous when the two portions are pivotably interconnected. The one portion is consequently connected in particular in a non-rotatable manner to a pivotably drivable shaft of the clamping device which also receives the clamping arm in a non-rotatable manner, whereas the other portion is mounted so as to be pivotable in the first-named portion.

According to a particularly preferred embodiment, it is provided that the first locking means is realized in a lever, in particular a one-armed lever, which comprises the two portions, in particular is formed by the two portions. A development of the first locking means which is structurally particularly simple is produced as a result.

In the case of another particularly preferred embodiment, it is provided that the first locking means is connected non-rotatably to an output shaft of the clamping device mounted in the housing, wherein the clamping arm is non-rotatably connected to the output shaft. In this connection, according to a further development, it is provided that the first portion is connected non-rotatably to the output shaft and, in the region of the end remote from the output shaft, receives the one roller, in particular rotatable roller, the bearing axis of which is arranged parallel to the bearing axis of the output shaft. A particularly favorable bearing arrangement and favorable force transmission between the two portions of the first locking means will occur when the first portion pivotably receives the second portion between the output shaft and the one projection, wherein the pivot axis of the second portion is arranged in the first portion parallel to the pivot axis of the output shaft. Said development additionally brings about simple kinematic interaction between the component parts of the first locking means and over and above this of the first locking means and the second locking means.

The two portions of the first locking means are preferably connected at a spacing to the pivot axis thereof by means of a fastening means under the effect of the spring force which is active in the opposite direction to the force of the fastening means. It is provided, in particular, that with the two locking means in a position in which they do not interact, the two portions abut against one another. If, consequently, the first locking means is moved into the locking position without the two locking means being in contact up to that point, the two portions abut against one another. If the two projections of the first locking means, with the second locking means prestressed, contact the second locking means, the two portions are moved apart from one another, in opposition to the spring force, and consequently no longer abut against one another. In this connection, the spacing between the projections with respect to one another is increased. When the locking position is reached, the projections are moved back toward one another such that in said locking position the two portions preferably abut against one another again. Depending on the arrangement of the projections and on the realization of the two portions of the first locking means as well as on the bearing arrangement of the two portions one inside the other, the two portions abut against one another when the first locking means pivots back out of the locking position or do not abut against one another again until the first locking means is moved out of contact with the second locking means.

One development that is particularly simple structurally is produced when the fastening means is realized as a screw, the screw penetrating a hole in the one portion and being screwed into a threaded bore of the other portion, wherein a spring is arranged between a screw head and the portion associated with said screw head. Said spring is preferably realized as a disk spring, in particular as a disk spring assembly.

The second portion of the first locking means is preferably developed such that it is realized as an L-shaped lever. In particular, the L-shaped lever is mounted in the region of the free end of the long leg of the L so as to be pivotable in the first portion and in the region of the free end of the short leg of the L receives the second roller, in particular rotatably, wherein the bearing axis of the second roller is parallel to the bearing axis of the first roller which is mounted in the first portion.

The second locking means also preferably comprises a roller which is mounted in an axis which is arranged parallel to the pivot axis of the clamping arm. Said roller is also preferably a rotatable roller which comprises the cylindrical form. It is also definitely possible for said cylindrical form to be generated by a helical spring.

It is deemed to be advantageous under said aspect when the rollers of the first locking means are realized as full rollers and the roller of the second locking means is formed by at least one helical spring, wherein the helical spring is mounted in a bearing bolt which is connected to the housing. The realization of the helical spring ensures that when there is contact between the two locking means, the helical spring is able to yield slightly, and consequently deforms under the effect of the two projections or roller of the first locking means. This contributes in a lasting manner to the reduction in wear in the region of the locking means.

It is likewise advantageous when, with the first locking means acting upon the second locking means, the two locking means are arranged in a top dead center position with respect to one another. Said top dead center ensures a particularly high locking force.

A clamping device according to the invention enables the force of the locking system to be adjusted. If, with the locking means in the locking position, only a relatively small pivot torque is introduced by means of the clamping arm, dimensioning the locking force or the locking torque of the interacting locking means in a lesser manner is sufficient. Where high torque is introduced by the clamping arm, a higher locking torque is to be correspondingly provided. The force of the locking system can be adjusted in dependence on the torque. The greater the force or the torque, the greater the force to compress or unlock the spring of the first locking means has to be. If the clamping arm is loaded in a lesser manner, the locking force or locking torque can be reduced as a result of reducing the spring force of the spring of the first locking means and consequently the force or the torque in order to transfer the locking means automatically or manually into the locking positions thereof is also lower. An operator can consequently move the clamping device into the locking position more simply. Due to the adjustability of the spring force of the first locking means and/or the possibility to vary the spacing between the projections of the first locking means due to the bearing arrangement of the two portions, there is significantly less wear on the projections of the first locking means, in particular on the rollers of the first locking means, and of the second locking means, in particular the roller or spring thereof.

Further features of the invention are shown and described further in the description of the drawing figures and in the drawing figures, as well as the detailed description of exemplary embodiments provided hereinafter, it being noted that all the individual features and all the combinations of individual features are to be considered separately and together as part of the invention.

BRIEF DESCRIPTION OF THE DRAWING FIGURES

The invention is shown in the accompanying drawing figures by way of one or more exemplary embodiments without being restricted thereto.

DETAILED DESCRIPTION OF EXEMPLARY EMBODIMENTS OF THE INVENTION

Figure 1:
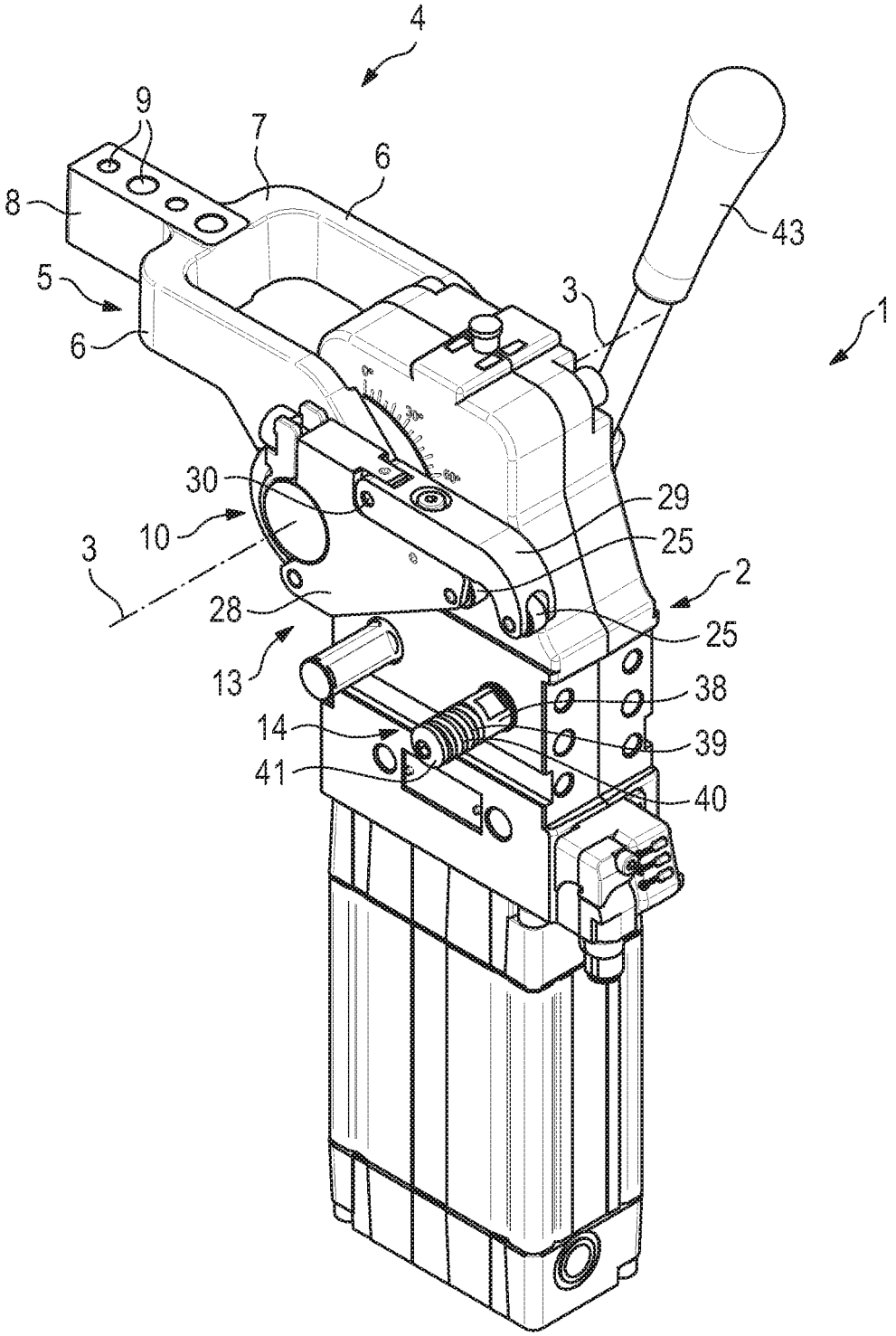
FIG. 1 shows a three-dimensional representation of the clamping device according to the invention, illustrated with a clamping arm of the clamping device in a non-clamping position, and consequently a non-locked position.
Figure 2:
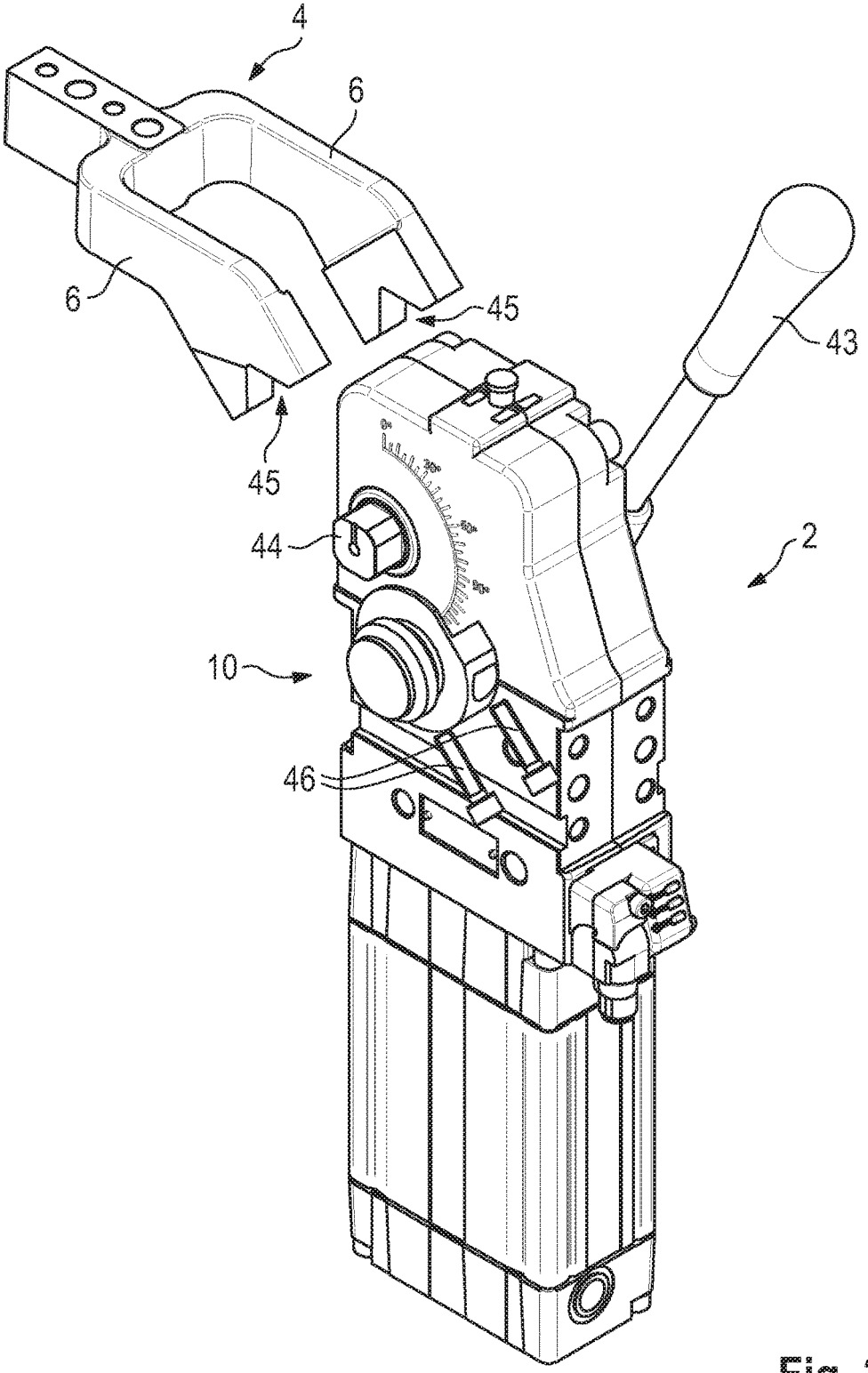
FIG. 2 shows the clamping device according to FIG. 1 in a partially mounted state.
Figure 3:
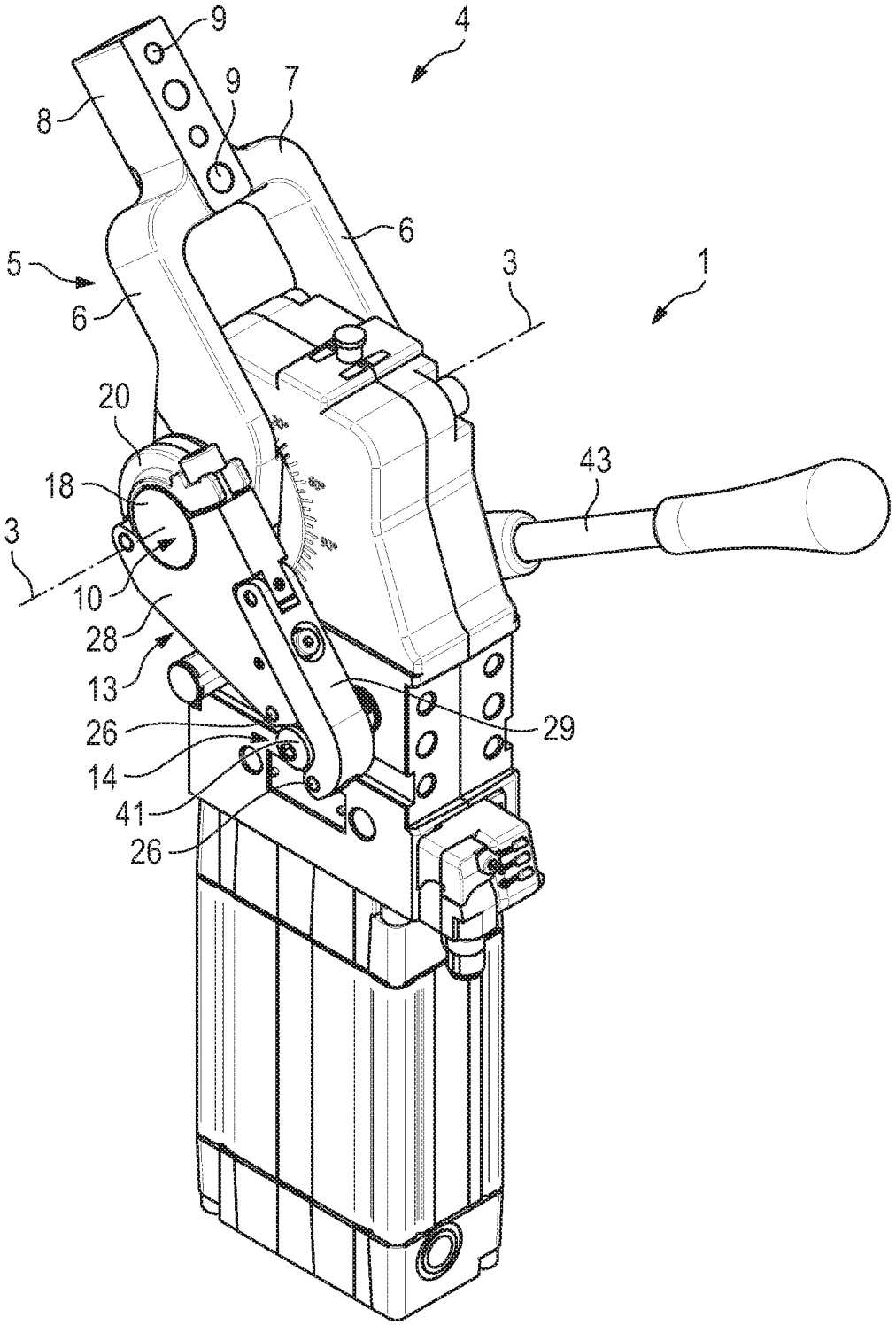
FIG. 3 shows the clamping device according to FIG. 1, illustrated with the clamping arm in a clamping position, and consequently a locked position.
Figure 4:
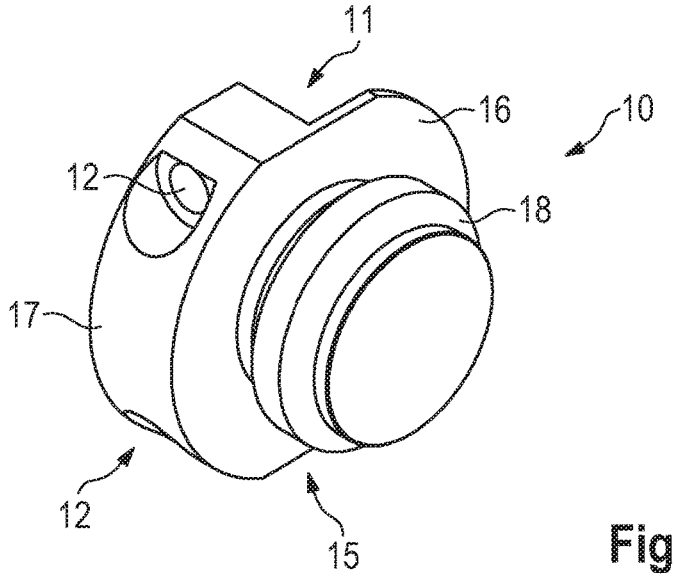
FIG. 4 shows a three-dimensional view of a clamping jaw which serves for receiving a first locking means of the clamping device.

A clamping device 1 which is used in particular in body construction in the automotive industry is illustrated. Said clamping device, as regards the operating principles thereof, is realized as a toggle lever clamping device, as is described, for example, in EP 2 548 700 A1.

The clamping device comprises a piston, which can be acted upon pneumatically on two sides, for pivoting a shaft 44, which is guided at both ends out of a housing 2 of the clamping device 1, about an axis 3 in opposite directions, a clamping arm 4 being non-rotatably connected to the shaft 44. The piston acts on said shaft 44 by means of a toggle lever. The stroke of the piston is length-adjustable, for example is modifiable by modifying the length of a piston rod between the piston and the toggle lever such that, as a result, at a defined closing angle, consequently an unchangeable closing position of the clamping arm 4, the opening angle thereof, consequently the opening position thereof is able to be modified. This is to be seen in particular against the background of structural circumstances in the region of the clamping device 1 only allowing for a certain opening angle of the clamping arm 4.

The shaft 44, which is secured axially in the housing 2, but is pivotably mounted, is guided out of the housing 2 on remote sides of the same. The ends of the shaft 44 are realized as positive-locking parts. More definitively, the respective shaft end comprises a square-shaped cross section, with beveled corners. The clamping arm 4, which is arranged outside the housing 2, comprises a U-shaped portion 5 with two legs 6 and one web 7 connecting said legs, and in addition an attachment 8 which is connected to the web 7, is directed away from the portion 5 and is provided with various bores 9. A tool or the like is connectable to the clamping arm 4 in said region of the attachment 8, consequently a structural element which is certainly relatively heavy in weight.

The respective leg 6, in the region of the end thereof remote from the web 7, comprises a right-angled recess 45, in the region of which the leg 6 interacts in a positive locking manner with two adjacent sides of the associated end of the shaft 44. For the non-rotatable connection of the clamping arm 4, in the region of the two legs 6 thereof, to the two ends of the shaft 44 projecting out of the housing 2, clamping jaws are provided which, corresponding to the recess of the respective leg 6, comprise a right-angled recess such that the clamping jaws are movable into operative connection with the two other sides of the respective shaft end in the region of said recesses. In the region of the remote ends, the respective clamping jaw comprises bores which are penetrated by screws which are screwed into threaded bores on both sides of the shaft end in the associated legs 6 of the clamping arm 4. A non-rotatable connection between the clamping arm 4 and the two ends of the shaft 44 projecting out of the housing 2 is ensured in this manner.

The clamping device 1 is provided with a particular locking system for locking the clamping arm in a respectively desired, predefined opening position of the clamping arm 4. In this connection, the locking system ensures that the clamping arm 4 is not able to be unintentionally pivoted out of the locked, open position.

Figure 5:
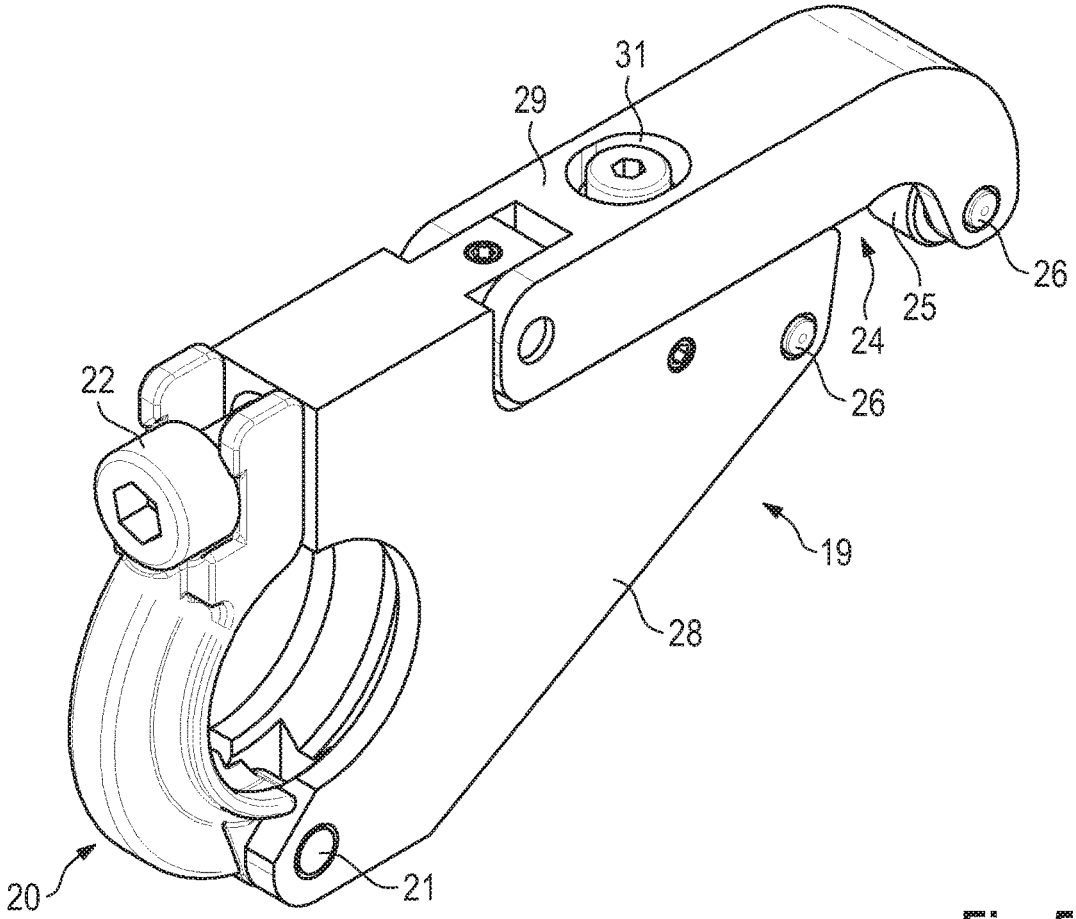
FIG. 5 shows a three-dimensional view of the first locking means.
Figure 6:
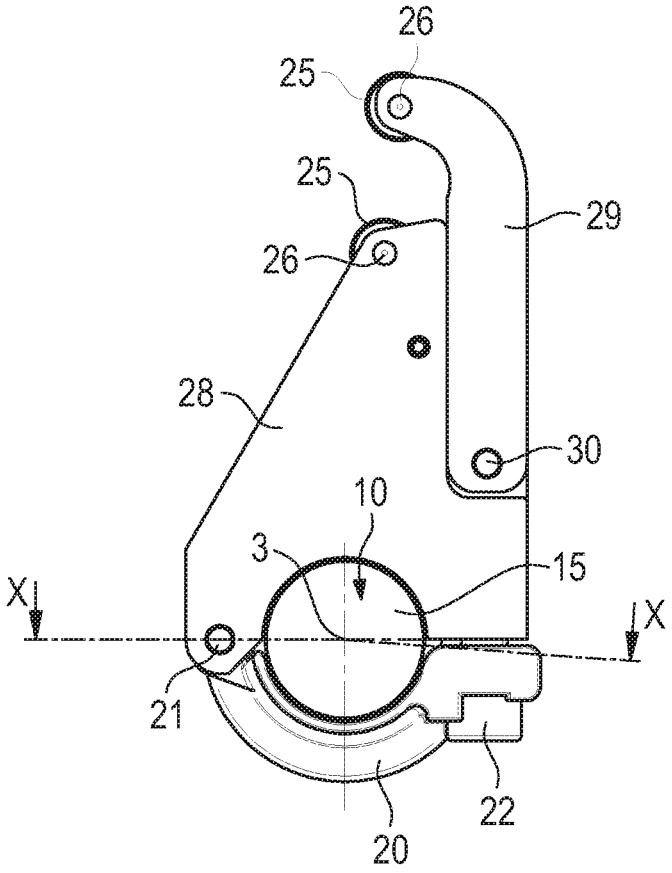
FIG. 6 shows a view of the first locking means, seen in the direction of the pivot axis thereof.
Figure 9:
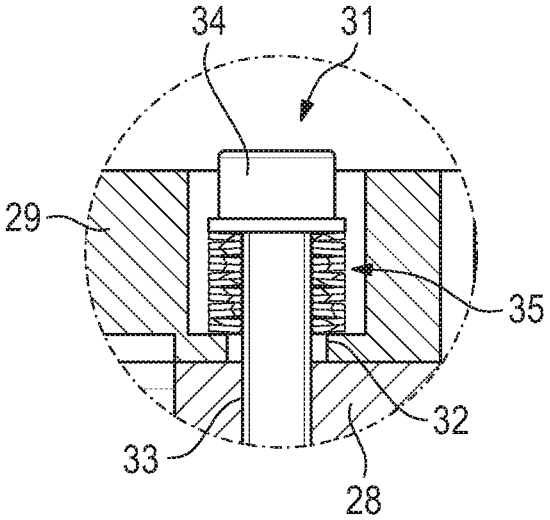
FIG. 9 shows an enlarged representation of the region Y illustrated in FIG. 8.

The clamping device 1 is developed in such a manner that said locking is able to be applied either on the one side of the housing 2 or on the side of the housing 2 remote from said side of the housing 2. With reference to the exemplary embodiment shown, a first locking means 13 and a second locking means 14 are positioned in the region of the one side of the housing 2. In order to be able to receive the first locking means 13, the clamping jaw usually used on the one or on the other side of the housing 2 is modified, that is to say the usual clamping jaw is demounted from the associated leg 6 of the clamping arm 4 and the modified clamping jaw 10 is screw-connected instead to said leg 6. The development of said clamping jaw 10 is produced in particular from the representation in FIGS. 5, 6 and 9.

The clamping jaw 10 is formed by a rotationally symmetrical body 15, a plate 16, which is connected to said body at the end face, and a clamping jaw part 17. Corresponding to the realization of the clamping jaw usually used, the clamping jaw part 17 comprises a right-angled recess 11 for the positive-locking connection to the two free sides of the shaft end, consequently to those sides against which the leg 6 does not abut. The plate 16 provides the connecting part between the clamping jaw part 17 and the body 15.

The clamping jaw part 17 is provided in the usual manner, consequently as the usually used clamping jaws, with two bores 12, for the insertion of screws 46 which are screwed into threaded bores of the leg 6 of the clamping arm 4 facing said clamping jaw 10 in order to realize the non-rotatable connection between the arrangement of clamping arm 4 and clamping jaw 10 and the shaft end associated with said clamping jaw 10. The body 15 provides the receiving means for the first locking means 13.

In an arbitrary, desired angular position with reference to the axis 3 of the shaft and the identical axis 3 of the rotationally symmetrical body 15, the first locking means 13 is connected to the clamping jaw 10 in the region of the rotationally symmetrical body 15. In this connection, the rotationally symmetrical body 15 is provided radially on the outside over its circumference with a profile 18 which is trapezoidal in cross section.

The first locking means 13 comprises a lever 19 and a clamping jaw 20. The clamping jaw 20 is mounted in the region of one end in an axis 21 which penetrates the lever 19. In the region of the end remote from the axis 21, the clamping jaw 20 is connectable to the lever 19 by means of a screw 22 which is screwable into a threaded bore of the level 19 for this purpose. The clamping jaw 20 is realized as a first half of a connecting clip and the lever 19 is developed in its region facing the clamping jaw 20 in such a manner that it comprises the function of the second half of the connecting clip. The clamping jaw 20 is releasably connected to the lever 19 in the region of the screw 22. In the contact region of the rotationally symmetrical body 15 with the lever 19 and the clamping jaw 20, the lever 19 and the clamping jaw 20 comprise a negative profile which is developed corresponding to the profile 18 of the body 15 such that the first locking means 13 is able to be connected non-rotatably to the clamping jaw 10. If the first locking means 13 is attached loosely on the clamping jaw 10, on account of the interaction between the rotationally symmetrical body 15 and the arrangement of the lever 19 and the clamping jaw 20, the lever 19 is able to be arranged in any arbitrary angular position with respect to the clamping jaw 10. The screw 22 is not tightened and consequently the non-rotatable connection is not made between the first locking means 13 and the clamping jaw 10, consequently the first locking means 13 and the shaft and accordingly the clamping arm 4, until the desired angular position is set. The clamping jaw 20 and the screw 22 consequently provide means for securing the first locking means 13 with reference to the receiving means which is formed by the body 15.

The first locking means 13 comprises a locking device 23 in the region of its end remote from the axis 3. Said locking device is movable into operative connection with the second locking means 14. The realization of the first locking means 13 is illustrated, for example, in FIG. 7. Said Figure shows that on the side which faces the second locking means 14, the lever 19 comprises a U-shaped recess 24 which is defined at the side by two projections, said projections being realized as rollers 25. Said rollers 25 are rotatably mounted in axes 26 which are arranged parallel to the axis 3. The rollers 25 are realized as cylindrical rollers and are identical in diameter. As a result, the averaged spacing between the axes 26 and the axis 3 of the lever 19 provides an effective radius on which a central axis 27 of the second locking means 14 is situated.

Figure 7:
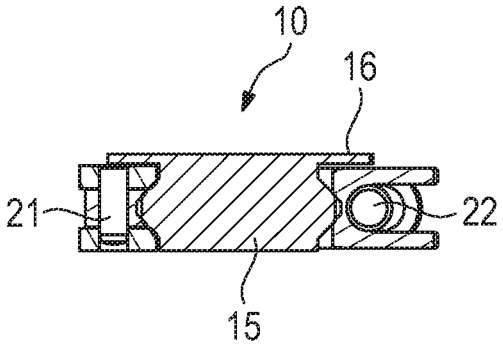
FIG. 7 shows a section according to the line X-X in FIG. 6.
Figure 8:
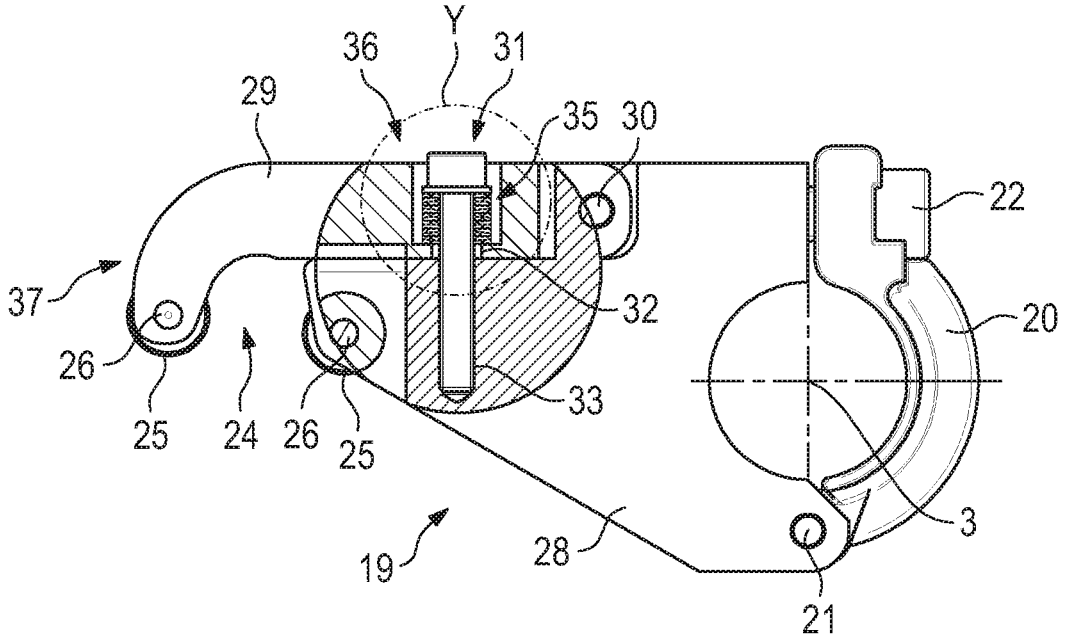
FIG. 8 shows a side view of the first locking means according to FIG. 6, shown in a partially sectioned manner.

The first locking means 13 comprises a first portion 28 which receives one roller 25 and a second portion 29 which receives the other roller 25. The two portions 28, 29, when the second locking means 14 acts on the two rollers 25, are movable toward one another in opposition to a spring force with the spacing between the rollers 25 increasing. To this end, the two portions 28, 29 are pivotably interconnected by means of an axis 30. The axis 30 is arranged parallel to the axes 26. The portion 28 is connected non-rotatably to the clamping jaw 10 and comprises the roller 25 in the region of the end remote from the axis 3. The portion 28 receives the portion 29 in a pivotable manner between the axis 3 and the roller 25 of the portion 28. The two portions 28 and 29 are connected at a spacing to the pivot axis 30 thereof by means of a fastening means, which is realized as a screw 31, under the effect of the spring force which is active in opposition to the force of the screw 31. In this connection, the two portions 28, 29, with the two locking means 13, 14 in a position in which they do not interact, abut against one another, as is illustrated in FIG. 7. The screw 31 penetrates a hole 32 in the portion 29 and is screwed into a threaded bore 33 of the other portion 28. A spring which is realized as a disk spring assembly 35 is arranged between the screw head 34 and the portion 29 associated with said screw head.

The portion 29 is realized as an L-shaped lever. Said lever is pivotably mounted in the portion 28 in the region of the free end of the long leg 36 by means of the axis 30 and receives the other roller 25 in the region of the free end of the short leg 37 of the L.

Figure 10:
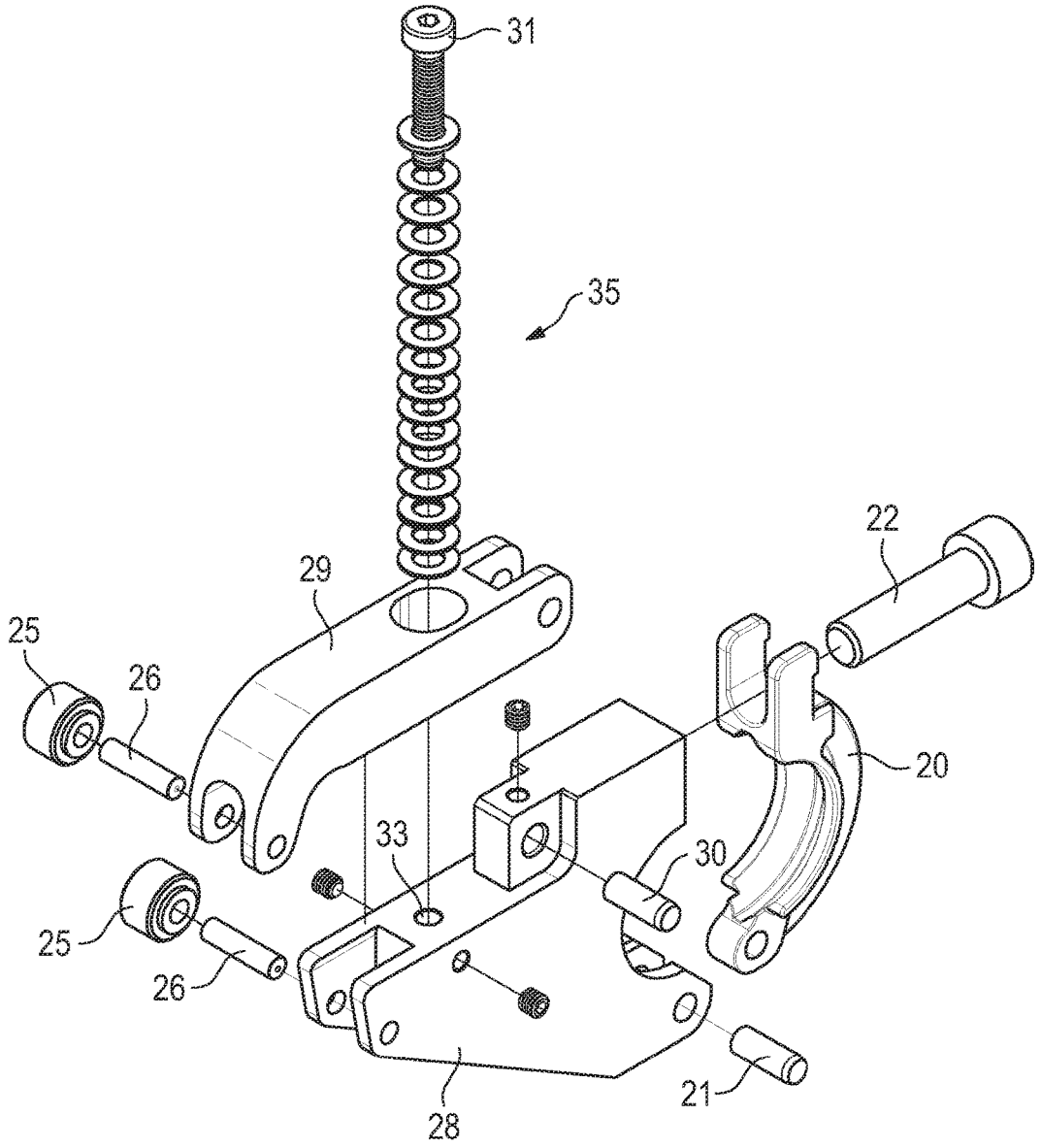
FIG. 10 shows an exploded representation of the first locking means.
Figure 11:
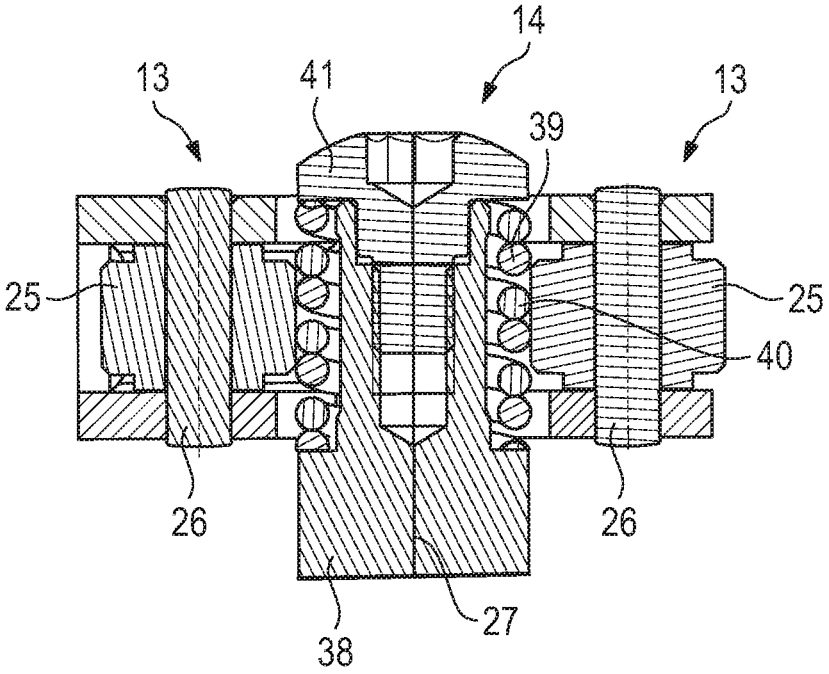
FIG. 11 shows the parts interacting in the locked position within the interaction range of the first locking means and second locking means, illustrated in a sectioned representation.

The second locking means 14, which is located within the pivot angle of the first locking means 13, as can be seen in particular from the representation in FIGS. 1 and 10, comprises a bearing bolt 38 which is connected to the housing 2. The axis 27 of the bearing bolt 38 is located, as previously described, on a part circle with the effective radius of the first locking means 13 about the axis 3. The axis 27 of the bearing bolt 38 is arranged parallel to the axis 3. The bearing bolt 38 penetrates two identically realized, cylindrical helical compression springs 39, 40 which are arranged screwed one inside another. Said spring assembly, which is formed by the two helical springs 39, 40, is supported on the bearing bolt 38 and is tensioned by means of a screw 41 which is screwed into the bearing bolt 38. The helical compression springs 39, 40 are consequently axially secured.

The method of operation of the locking device 23 is described below by way of the representation in FIGS. 12 to 17 for three different pivot states of the first locking means 13.

Figure 12:
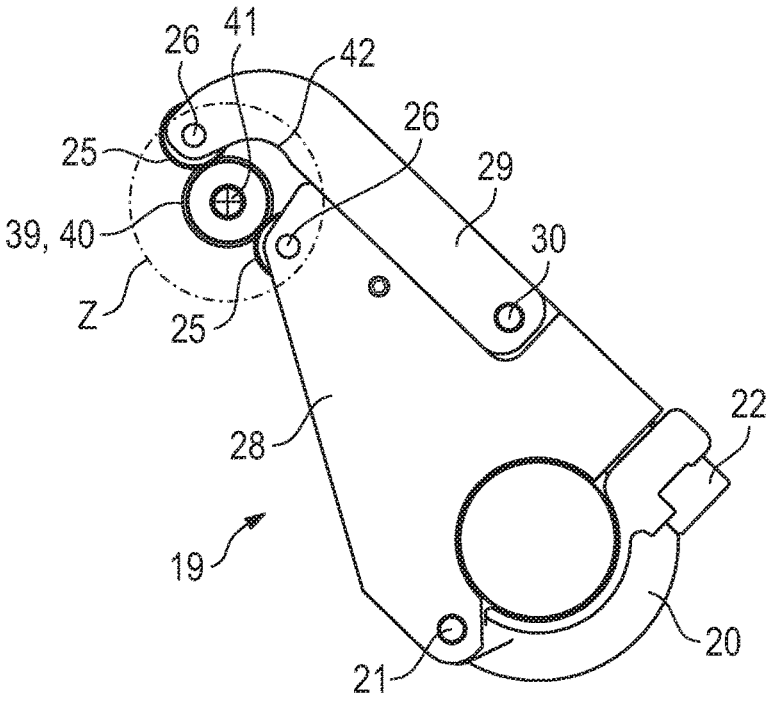
FIG. 12 shows the arrangement of the first locking means and second locking means where the two locking means have initial contact.
Figure 13:
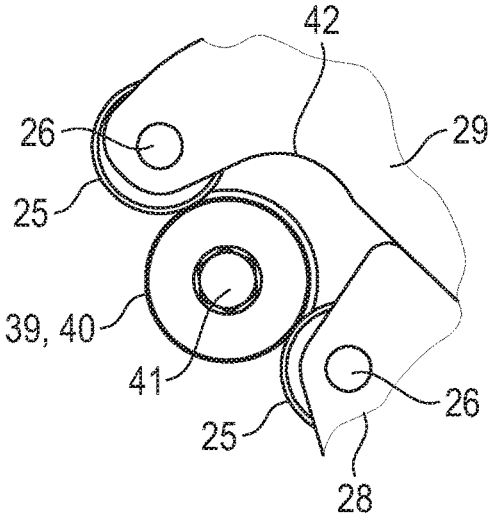
FIG. 13 shows an enlarged representation of the detail Z according to FIG. 12.

As can be seen from the representation in FIGS. 12 and 13, the lever 19 is positioned with reference to the rollers 25 in such a manner that when the first locking means 13 pivots in the direction of the second locking means 14, the rollers 25 contact the helical compression springs 39, 40. It can clearly be seen from the Figures that the outside diameter of the helical compression springs 39, 40 is somewhat greater than the spacing between the two rollers 25.

Figure 14:
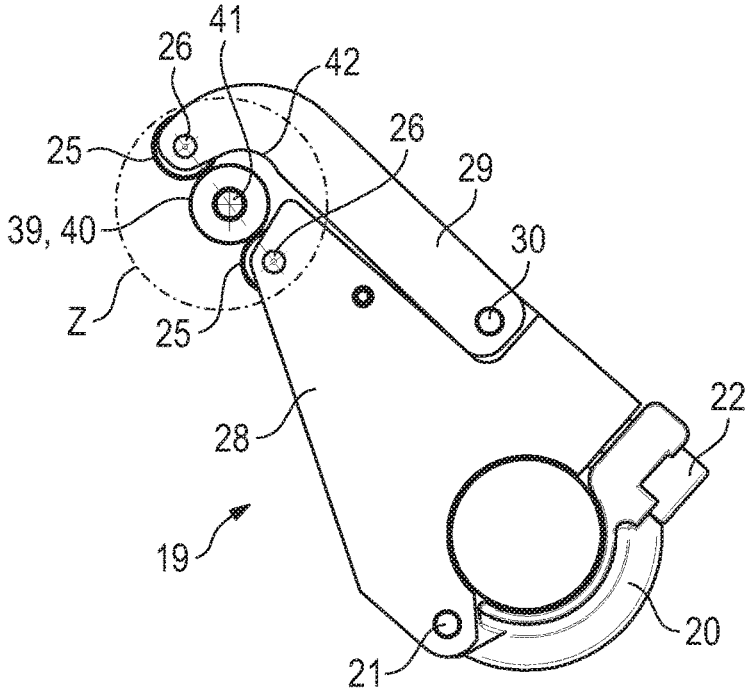
FIG. 14 shows the arrangement of the first locking means and second locking means with the first locking means in a center position after it has been pivoted further out of the position of initial contact according to FIGS. 12 and 13.
Figure 15:
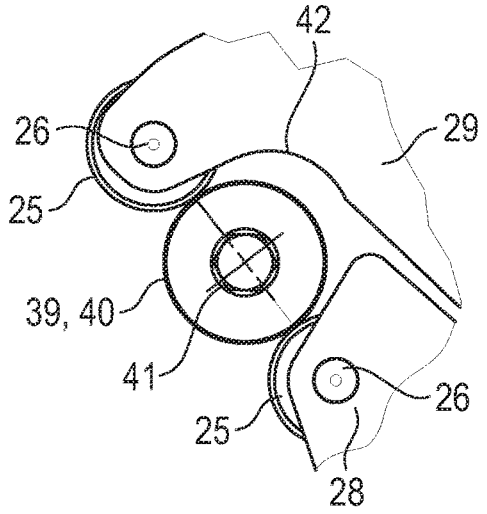
FIG. 15 shows an enlarged representation of the detail Z according to FIG. 14.
Figure 16:
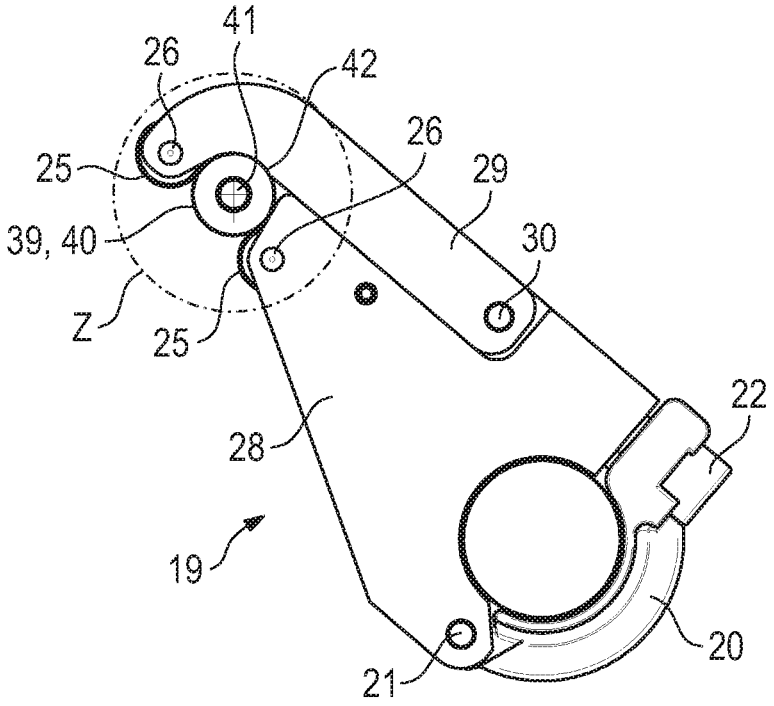
FIG. 16 shows the arrangement of the first locking means and second locking means in the locking position thereof, consequently in the end position of the clamping arm.
Figure 17:
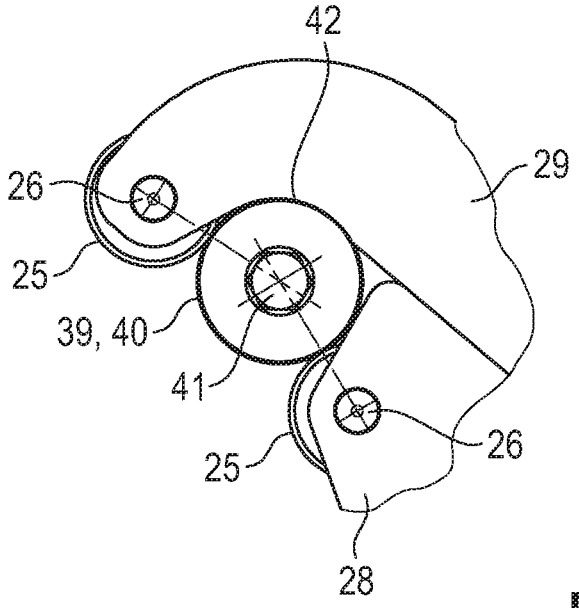
FIG. 17 shows an enlarged representation of the detail Z according to FIG. 16.

When applying an increased force or an increased torque which acts on the lever 19, the portion 29 of the lever 19 can pivot slightly about the axis 30 with reference to the portion 28 of the lever 19 in opposition to the set spring force of the disk spring assembly 35 such that the spacing between the rollers 25 increases slightly and accordingly the rollers 25, with a relatively small amount of pressure applied onto the helical compression springs 39, 40 and consequently said helical compression springs deforming relatively slightly, are able to roll along the helical compression springs 39, 40. Said center position or intermediate position of the first locking means 13 is illustrated in FIGS. 14 and 15. Accordingly, the lever 19, without requiring really high torque to be introduced into the lever 19, can be pivoted further into the end position of the first locking means 13 shown in FIGS. 16 and 17 and consequently into the end position of the clamping arm 4. In said end position, the disk spring assembly 35 has pressed the portion 29 against the portion 28 again, as is illustrated in FIG. 7, and in said end position according to FIGS. 16 and 17 of the first locking means 13, the two locking means 13, 14 are arranged in a top dead center position with respect to one another. In said end position, the spacing between the rollers 25 is consequently once again slightly smaller than the diameter of the helical compression springs 39, 40.

When an increased force or an increased torque, which acts on the lever 19, is applied for the purposes of producing the locking, the two portions 28, 29 pivot against the force of the disk spring assembly 35 relative to one another, whereupon, with the helical compression springs 39, 40 deformed relatively slightly, the rollers 25 pass the helical compression springs 39, 40 and reach the region of the U-shaped recess 24 which is formed by the two portions 28, 29. In the end position of the locking means 13, the rollers 25 contact the helical compression springs 39, 40 and they lie flat in the bottom region 42 of the recess 24, as can be seen in the representation in FIGS. 16 and 17. The first locking means 13, consequently the lever 19 can only be moved out of said locked position if the lever 19 is acted upon with an increased force or an increased torque which is greater than a torque which acts by means of the clamping arm 4, where applicable taking into consideration a load connected to the clamping arm 4, on the shaft and consequently the first locking means 13.

The first locking means 13 can be moved into the locking position and out of the same pneumatically as a result of acting upon the cylinder or in particular manually. Under said last-mentioned aspect, the toggle lever of the clamping device 1 and consequently the shaft of the clamping device 1 is also pivotable externally by means of a hand lever 43. To this end, a shaft is arranged on both sides of the housing 2, parallel to the pivot axis 3 of the shaft, the hand lever 43 being non-rotatably connected to the shaft end of the last-mentioned shaft which projects out of the housing 2 on the side remote from the first locking means 13. The lever 19 of the first locking means 13 is able to be pivoted as a result of pivoting the hand lever 43 and consequently of pivoting said shaft.

The invention claimed is:

1. A clamping device, comprising:

a housing;

a clamping arm which is mounted so as to be pivotable in the housing;

a first locking means which is pivotable corresponding to the pivoting movement of the clamping arm about a pivot axis of the first locking means; and a second locking means mounted in the housing which is arranged in the pivot path of the first locking means;

wherein the first locking means and the second locking means interact in an end position of the clamping arm;

wherein the first locking means, in the region of an end of the first locking means which is remote from the pivot axis and on a side of the first locking means facing the second locking means, comprises a recess which is defined at the side by a first projection and a second projection;

wherein the second locking means contacts the first projection and the second projection when the clamping arm pivots into the end position and is inserted into the recess;

wherein the first locking means comprises a first portion which receives the first projection and a second portion which receives the second projection; and wherein the first portion and the second portion of the first locking means, with the second locking means acting upon the first projection and the second projection, are movable toward one another against a spring force with the spacing between the first projection and the second projection increasing.

2. The clamping device according to claim 1, wherein the first projection and the second projection of the first locking means are realized as rollers which are rotatably mounted.

3. The clamping device according to claim 1, wherein the first portion and the second portion of the first locking means are pivotably interconnected.

4. The clamping device according to claim 1, wherein the first locking means is realized in the manner of a one-armed lever which is formed by the first portion and the second portion.

5. The clamping device according to claim 1, wherein the first locking means is connected non-rotatably to an output shaft of the clamping device mounted in the housing, and wherein the clamping arm is connected non-rotatably to the output shaft.

6. The clamping device according to claim 5, wherein the first portion of the first locking means is connected non-rotatably to the output shaft and in the region of an end remote from the output shaft receives the first projection in the form of a rotatable roller having bearing axis which is arranged parallel to a bearing axis of the output shaft.

7. The clamping device according to claim 6, wherein the first portion of the first locking means pivotably receives the second portion of the first locking means between the output shaft and the first projection of the first portion, and wherein the pivot axis of the second portion is arranged in the first portion parallel to the bearing axis of the output shaft.

8. The clamping device according to claim 7, wherein the first portion and the second portion are connected at a spacing to the pivot axis by a fastening means under the effect of the spring force which acts in a direction opposite to a force of the fastening means.

9. The clamping device according to claim 8, wherein with the first locking means and the second locking means in a position in which they do not interact, the first portion and the second portion of the first locking means abut against one another.

10. The clamping device according to claim 9, wherein the fastening means is realized as a screw which penetrates a hole in the second portion of the first locking means and is screwed into a threaded bore of the first portion, and wherein a disk spring assembly is arranged between a screw head and the second portion of the first locking means associated with said screw head.

11. The clamping device according to claim 1, wherein the second portion of the first locking means is realized as an L-shaped lever.

12. The clamping device according to claim 11, wherein the L-shaped lever is mounted in the region of a free end of a long leg of the L-shaped lever so as to be pivotable in the first portion of the first locking means and in the region of a free end of a short leg of the L-shaped lever receives the second projection in the form of a roller associated with the second portion of the first locking means, and wherein a bearing axis of said roller is parallel to a bearing axis of the first projection in the form of a roller mounted in the first portion of the first locking means.

13. The clamping device according to claim 2, wherein the second locking means comprises a roller which is mounted about an axis which is arranged parallel to the pivot axis of the clamping arm.

14. The clamping device according to claim 1, wherein in the end position of the first locking means, the first locking means and the second locking means are arranged in a top dead center position with respect to one another.

15. The clamping device according to claim 13, wherein the rollers of the first locking means are realized as full rollers made of a metal, and wherein the roller of the second locking means is formed by at least one helical spring mounted in a bearing bolt which is connected to the housing.

* * * * *